US008376806B2

(12) United States Patent
Sun et al.

(10) Patent No.: US 8,376,806 B2
(45) Date of Patent: Feb. 19, 2013

(54) TOYS WITH VIEW PORTS

(75) Inventors: Steed Sun, San Gabriel, CA (US); Ruben Martinez, Whittier, CA (US); Peter Fan, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 154 days.

(21) Appl. No.: 11/555,091

(22) Filed: Oct. 31, 2006

(65) Prior Publication Data

US 2007/0173174 A1 Jul. 26, 2007

Related U.S. Application Data

(60) Provisional application No. 60/733,343, filed on Nov. 1, 2005.

(51) Int. Cl.
*A63H 17/00* (2006.01)
*A63H 33/22* (2006.01)

(52) U.S. Cl. ..... 446/431; 446/219; 446/435

(58) Field of Classification Search ..... 446/219, 446/431, 435

See application file for complete search history.

(56) References Cited

U.S. PATENT DOCUMENTS 3,244,072 A 4/1966 Dowling
3,817,594 A 6/1974 Fischer
4,083,143 A 4/1978 Allen
4,192,093 A 3/1980 Hamano
4,194,318 A * 3/1980 Watanabe ..... 446/435
4,226,292 A * 10/1980 Monte et al. ..... 180/6.5
4,236,345 A * 12/1980 Inoue ..... 446/197
4,249,339 A * 2/1981 Crain et al. ..... 446/231
4,345,402 A 8/1982 Hanson et al.
4,382,347 A 5/1983 Murakami
4,418,495 A 12/1983 Kennedy et al.
4,464,860 A 8/1984 Onodera
4,478,313 A 10/1984 Wakase
4,478,498 A 10/1984 Ohno
4,500,299 A * 2/1985 Kelley et al. ..... 446/230
4,504,239 A 3/1985 Kulesza et al.
4,516,948 A 5/1985 Obara
4,605,232 A * 8/1986 Hundstad ..... 273/348.1
4,606,618 A 8/1986 Geller
4,690,654 A 9/1987 DeLaney
4,737,135 A * 4/1988 Johnson et al. ..... 446/430
4,889,515 A 12/1989 Auer et al.
4,913,538 A 4/1990 Wakayama et al.
4,913,541 A 4/1990 Wakayama et al.
5,299,809 A * 4/1994 Evangelista et al. ..... 273/380
5,633,753 A 5/1997 Fantone et al.
5,924,910 A * 7/1999 Liu ..... 446/470
5,926,312 A 7/1999 Wu
5,986,802 A 11/1999 Byers
6,086,446 A * 7/2000 Arriola ..... 446/308
6,106,361 A 8/2000 Petris
6,236,505 B1 5/2001 Fleck
6,497,608 B2 * 12/2002 Ho et al. ..... 446/456
6,746,304 B1 * 6/2004 Liu ..... 446/454
6,768,583 B2 7/2004 Shin
D509,522 S 9/2005 Ueda et al.

(Continued)

OTHER PUBLICATIONS

U.S. Appl. No. 11/421,625, filed Jun. 1, 2006, applicant's Martinez et al, currently unpublished.

*Primary Examiner* — Gene Kim
*Assistant Examiner* — Urszula M Cegielnik
(74) *Attorney, Agent, or Firm* — Kolisch Hartwell, PC

(57) ABSTRACT

A toy including a housing and at least one view port disposed within the housing and adapted to permit a user to view objects through the at least one view port.

11 Claims, 4 Drawing Sheets

U.S. PATENT DOCUMENTS

| | | | | |
|---|---|---|---|---|
| D513,026 | S | 12/2005 | Yanai et al. | |
| 7,304,810 | B2 * | 12/2007 | Hilliker | 359/804 |
| 7,349,153 | B2 * | 3/2008 | Rosenblum | 359/402 |
| 2003/0190856 | A1 * | 10/2003 | Peters | 446/175 |
| 2004/0032652 | A1 | 2/2004 | Holmes et al. | |
| 2004/0077285 | A1 * | 4/2004 | Bonilla et al. | 446/491 |
| 2005/0042974 | A1 | 2/2005 | Agostini et al. | |
| 2006/0178085 | A1 * | 8/2006 | Sotereanos et al. | 446/456 |
| 2006/0293102 | A1 * | 12/2006 | Kelsey | 463/37 |

* cited by examiner

Fig. 10
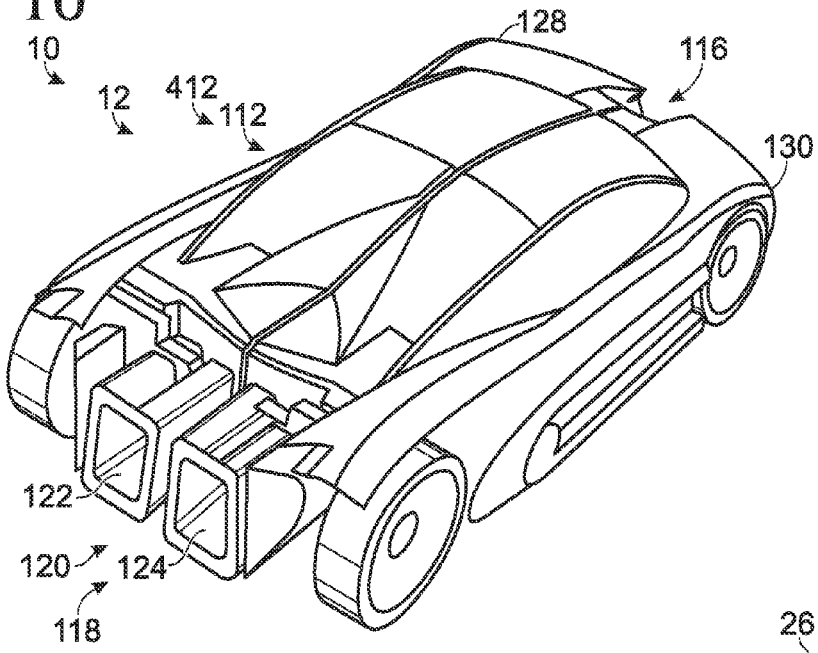
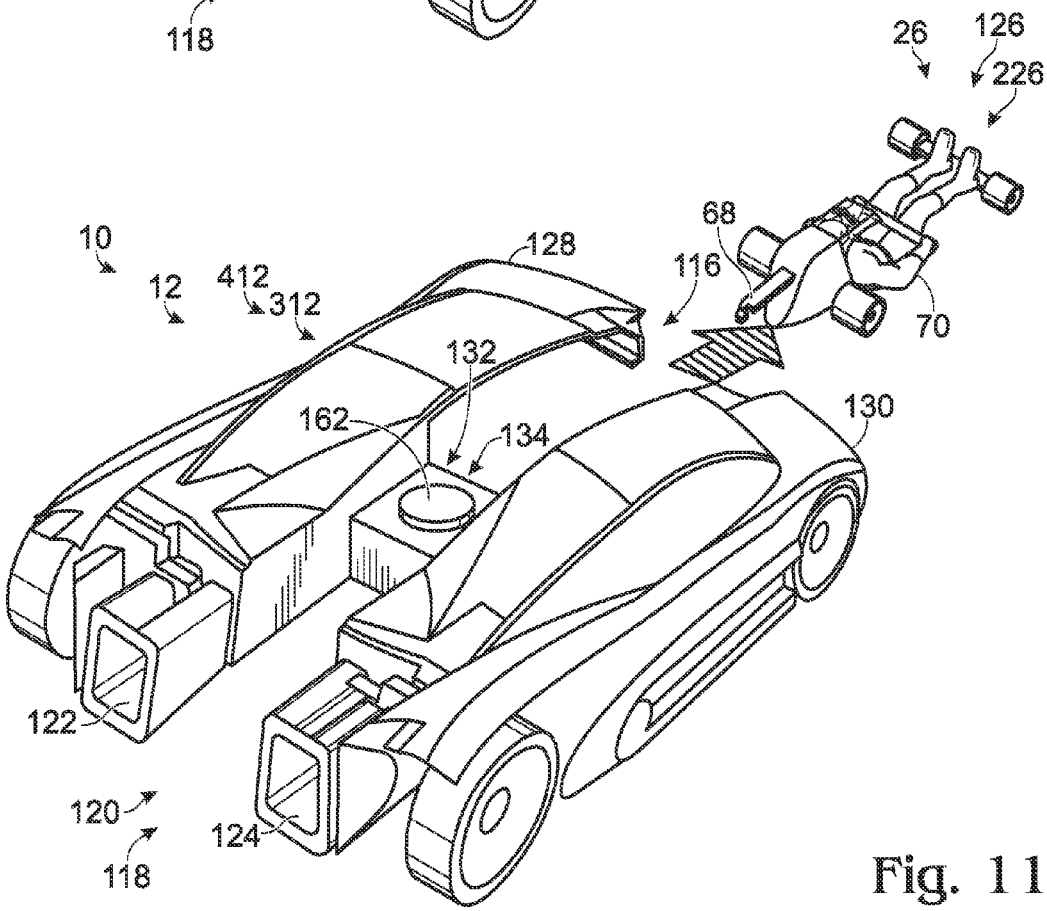
Fig. 11

TOYS WITH VIEW PORTS

CROSS-REFERENCE TO RELATED APPLICATIONS

This application is based upon and claims priority under 35 U.S.C. §119(e) to U.S. provisional patent application Ser. No. 60/733,343, entitled "TOY VEHICLES WITH INTEGRAL BINOCULARS," filed on Nov. 1, 2005, the entire disclosure of which is incorporated herein by reference in its entirety for all purposes.

BACKGROUND

The present disclosure relates to toys. More particularly, the present disclosure relates to toys with view ports for viewing objects therethough.

SUMMARY

Toys according to the present disclosure include one or more view ports for viewing objects therethough. In some embodiments the one or more view ports are adapted to magnify objects viewed therethrough. In some embodiments the toys include a housing in the form of a toy vehicle. In some embodiments, a projectile may be launched from the housing.

BRIEF DESCRIPTION OF THE DRAWINGS

FIG. 10 is an isometric view of a toy vehicle with integral view ports, the toy vehicle shown in a closed configuration.

FIG. 11 is an isometric view of a first toy vehicle with integral view ports, the first toy vehicle shown in an open configuration, and a second toy vehicle launched from the first toy vehicle.

DETAILED DESCRIPTION

Figure 1:
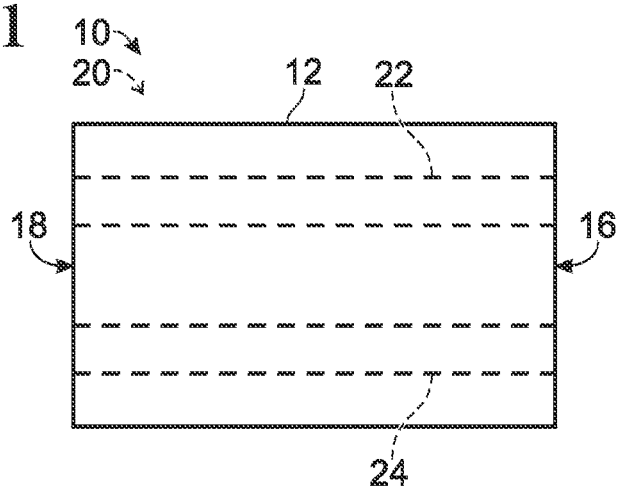
FIG. 1 is a schematic diagram of a toy with integral view ports.

One embodiment of a toy is schematically illustrated in FIG. 1 and is generally indicated at 10. As shown, toy 10 may include a housing 12. Housing 12 may include a front end 16 and a rear end 18. Housing 12 may be configured to integrally include one or more view ports 20. For example, in the illustrated schematic, one or more view ports 20 includes a left view port 22 and a right view port 24. In some embodiments, view ports 20 may be referred to as binoculars. In other embodiments, a view port 20 may be referred to as a telescope. In yet other embodiments, a view port 20 may be referred to as a microscope.

An illustrative, non-exclusive embodiment of housing 12 may take the form of a toy vehicle. For example, housing 12 may include various components such as a toy vehicle would typically include, including wheels, chassis, axles, etc. The toy vehicle may be, but is not required to be, functional, in that the wheels may roll permitting a user to easily push the toy vehicle on a surface. Housing 12 may also take the form of other toys. For example, housing 12 may be in the form of a space-ship, a boat, or any other toy that may be enjoyable by children. Further, housing 12 may, but is not require to, include a source of motive power. For example, housing 12 may integrally include a battery or batteries and a motor, or a wind-up mechanism that provides power to a toy part or part, such as integral wheels in embodiments where housing 12 is in the form of a toy vehicle.

One or more view ports 20 may take any suitable configuration for effectively providing a defined passage for viewing objects through housing 12. In some embodiments, view ports 20 may functionally provide magnification of objects viewed through the one or more view ports. For example a view port 20 may, but is not required to, include various components including lenses, mirrors, focus mechanisms, etc. View ports 20 may have 4×30 magnification power for example. Alternatively, view ports 20 may not provide effective magnification at all, and may only provide a simulated set of binoculars, telescope, or microscope. For example, users may be able to view objects through the one or more view ports 20, but without any effective magnification. Toy 10 may thus be able to be used as a toy of imagination while pretending to be a spy, a super hero, a scientist, an astronomer, or other imaginary character. Additionally or alternatively, users, through the one or more view ports, may be able to view a light-filtered distorted, or otherwise altered line of sight, or to view an embedded picture, graphic, or image.

Figure 2:
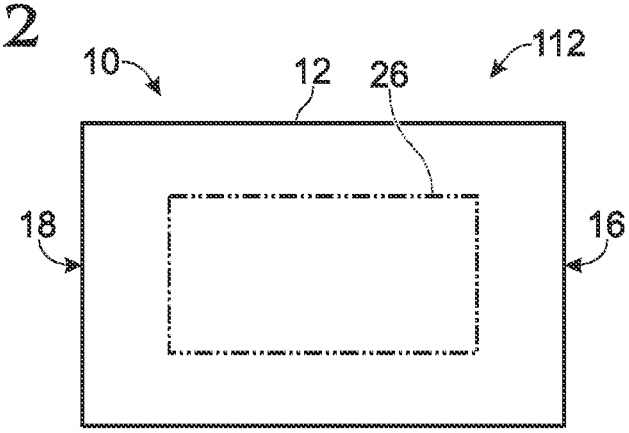
FIG. 2 is schematic diagram of a toy with an object housed within the toy.

Another embodiment of toy 10 is schematically illustrated in FIG. 2. As shown, toy 10 may include an object 26, generally enclosed within housing 12. An illustrative, non-exclusive embodiment of object 26 may take the form of a toy vehicle, or a second toy vehicle in embodiments of toy 10 in which housing 12 is also in the form of a toy vehicle. For example, object 26 may include various components such as a toy vehicle would typically include, including wheels, chassis, axles, etc. Object 26 may be, but is not required to be, a functional toy vehicle, in that the wheels may roll, permitting object 26 to easily roll on a surface. Object 26 may also take the form of other toys. For example, object 26 may take the form of a space-ship, a boat, or any other toy that may be enjoyable by children.

Figure 3:
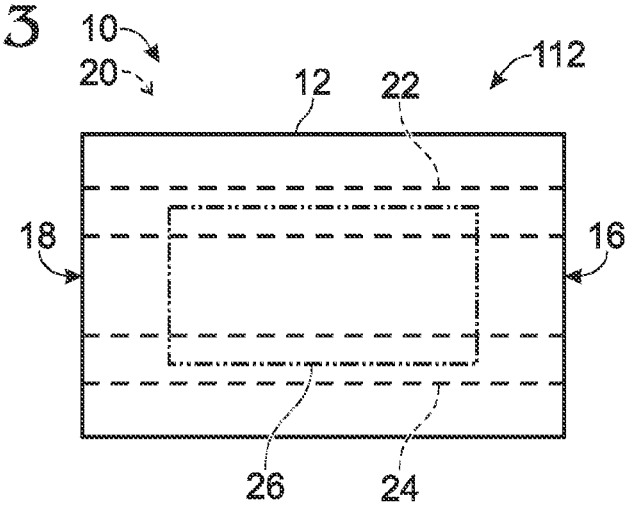
FIG. 3 is schematic diagram of a toy with view ports and an object housed within the toy.
Figure 4:
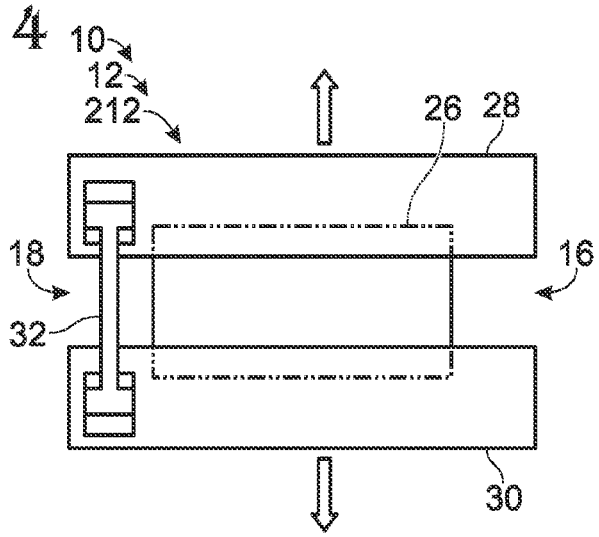
FIG. 4 is schematic diagram of a toy with an object housed within the toy, the toy shown in an intermediate open configuration.
Figure 5:
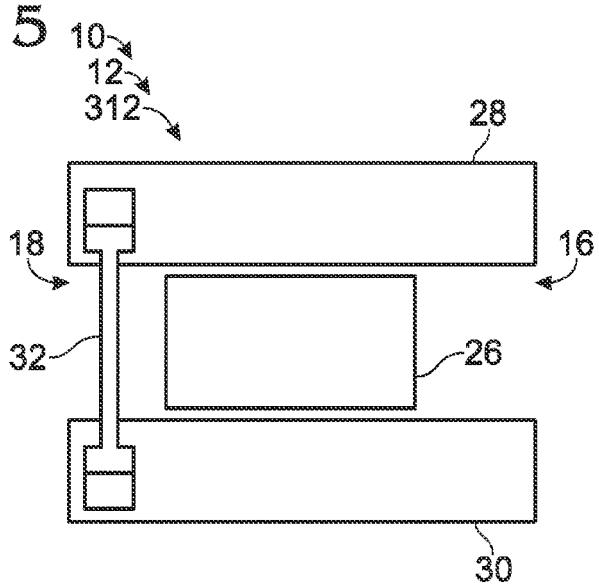
FIG. 5 is schematic diagram of a toy with an object housed within the toy, the toy shown in a fully open configuration.
Figure 6:
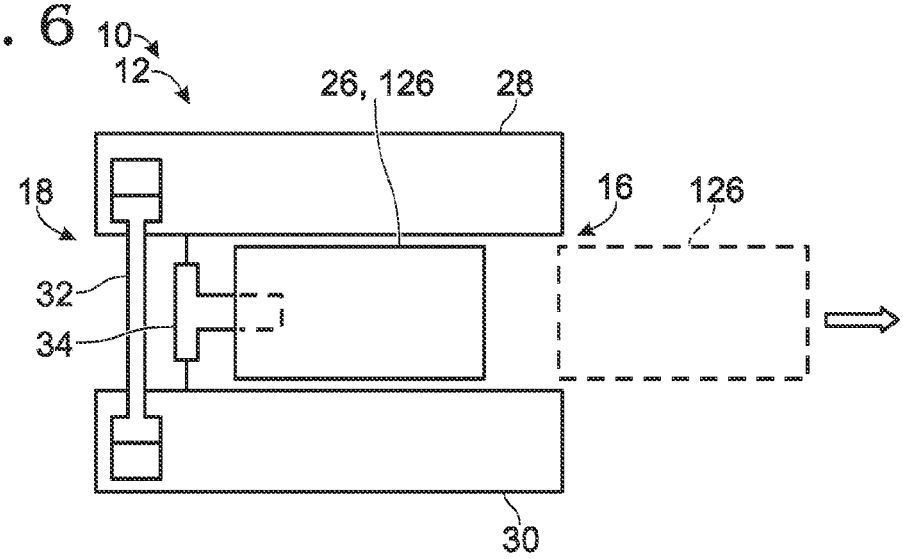
FIG. 6 is schematic diagram of a toy with a launching mechanism for launching an object housed within the toy, the toy shown in a fully open configuration and the object shown launching from the toy.

Toy 10 may incorporate both one or more view ports 20 and object 26, as schematically illustrated in FIG. 3. FIGS. 4-6 schematically illustrate toy 10 without view ports 20; however toy 10 as illustrated and discussed herein may include view ports 20 in some embodiments and may not include view ports 20 in other embodiments.

As schematically illustrated in FIG. 4, housing 12 may include a first, or left, portion 28 and a second, or right, portion 30. Left and right portions 28, 30 may be operatively coupled by a connecting mechanism 32. Connecting mechanism 32 may be configured to permit separation of left and right portions 28, 30, as generally shown and schematically indicated by arrows in FIG. 4. Housing 12 may be configured to be positioned between a closed configuration 112, as generally indicated in FIGS. 2-3, and a range of open configurations including an intermediate open configuration 212, as generally indicated in FIG. 4, and a fully open configuration 312, as generally indicated in FIG. 5.

Connecting mechanism 32 may take any suitable configuration for effectively providing functional connection and separation of left and right portions 28, 30. For example, connecting mechanism 32 may include a locking mechanism such that user manipulation is required to reconfigure housing 12 from closed configuration 112 to the range of open configurations. The locking mechanism may be a simple frictional connection such as a press-fit, a snap-fit, or other suitable frictional connection. Connecting mechanism 32 may include a button or other device configured to be engaged by a user and further configured to permit separation of left and right portions 28, 30. Additionally or alternatively, connecting mechanism 32 may include a bias member, such as a spring, configured to bias housing 12 to fully open configuration 312. In such embodiments, user manipulation of connecting mechanism 32, the locking mechanism, or other suitable component of toy 10, may disengage left and right portions 28, 30, thereby allowing the bias member to configure housing 12 into the range of open configurations.

As schematically shown in FIG. 5, when housing 12 is in fully-open configuration 312, object 26 may generally be able to be removed from within housing 12. Though schematically shown in FIG. 5 to be fully disengaged from housing 12, when housing 12 is in fully-open configuration 312, object 26 may still be engaged with various components of housing 12.

As schematically shown in FIG. 6, toys 10 may, but are not required to in all embodiments, include a releasing, or launching, mechanism 34, which may be operatively coupled to housing 12 (FIG. 6) and/or connecting mechanism 32 (as shown in FIG. 11), and configured to provide motive power to object 26. In such embodiments where toy 10 includes launching mechanism 34, object 26 may be a projectile 126 configured to be propelled away from housing 12 as generally indicated in FIG. 6. As discussed, an illustrative, non-exclusive embodiment of object 26, and thus projectile 126, may take the form of a toy vehicle.

Figure 7:
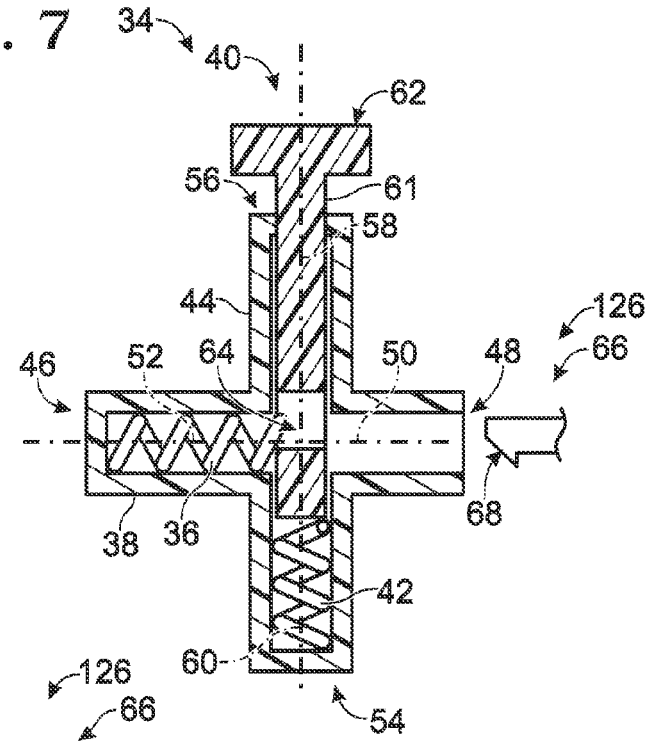
FIG. 7 is a schematic fragmentary cross-sectional diagram of an illustrative example of a launching mechanism and launching mechanism engagement region of a projectile, useable in the toy of FIG. 6 and shown with the projectile disengaged.
Figure 8:
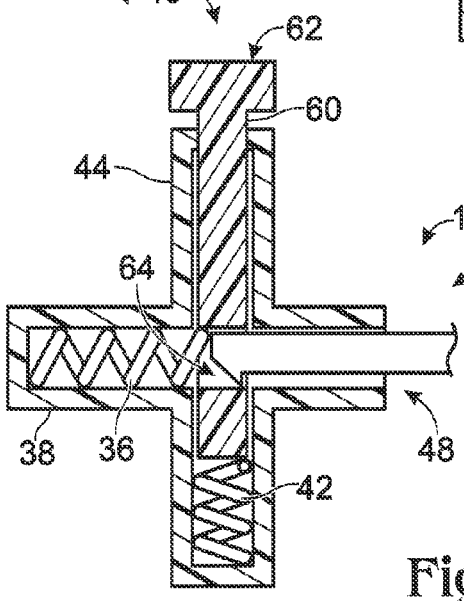
FIG. 8 is another schematic fragmentary cross-sectional diagram of the launching mechanism and launching mechanism engagement region of a projectile of FIG. 7, shown with the projectile partially inserted into the launching mechanism.
Figure 9:
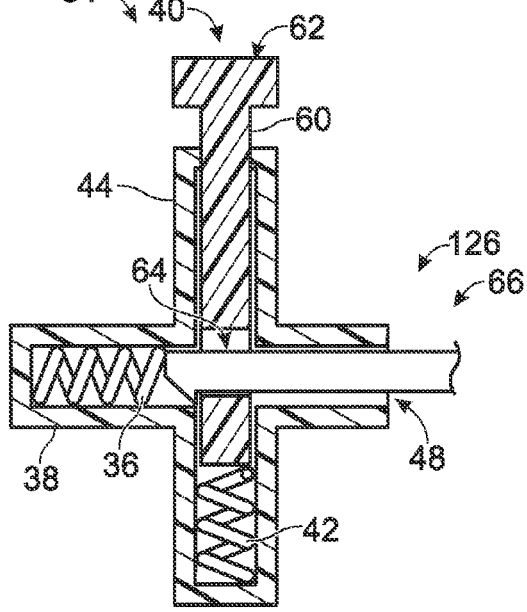
FIG. 9 is another schematic fragmentary cross-sectional diagram of the launching mechanism and launching mechanism engagement region of a projectile of FIG. 7, shown with the projectile engaged within the launching mechanism.

Turning now to FIGS. 7-9, a non-exclusive illustrative example of launching mechanism 34 is schematically shown. A similar launching mechanism is described in U.S. patent application Ser. No. 11/421,625, entitled "TOY PROJECTILE LAUNCHING DEVICES," the entire disclosure of which is hereby incorporated herein by reference in its entirety for all purposes. As indicated, launching mechanism 34 may include a propulsion spring 36, a propulsion spring housing 38 configured to house propulsion spring 36, a propulsion spring release member 40, a propulsion spring release spring 42, and a propulsion spring release member housing 44, configured to house propulsion spring release spring 42 and slidingly retain propulsion spring release member 40. As used herein, the term spring may include any resilient bias member configured to resiliently provide a force or forces, either in compression, tension, torsion, or any other appropriate method. For example, as schematically depicted in FIGS. 7-9, the term spring may include a coil spring.

Propulsion spring housing 38 may be closed, partially closed, or configured at least to retain propulsion spring 36, at a first end 46, and may be open, or partially open at a second end 48. Propulsion spring housing 38 may have a longitudinal axis 50, and propulsion spring housing 40 may similarly have a longitudinal axis 52 generally coaxial to longitudinal axis 50. Propulsion spring release member housing 44 may be closed, partially, closed, or configured at least to retain propulsion spring release spring 42, at a first end 54 between propulsion spring release member 40 and first end 54. Propulsion spring release member housing 44 may be open, or partially open at a second end 56. Propulsion spring release spring 42 may have a longitudinal axis 60, and propulsion spring release member housing 44 may similarly have a longitudinal axis 58 generally coaxial to longitudinal axis 60.

Propulsion spring release member 40 may include a shaft or similar structure 61, a user engagement surface 62, and a passage 64 extending through the shaft. Propulsion spring housing 38 may be fixedly coupled to propulsion spring release member housing 44, as indicated, or in any other suitable arrangement.

Projectile 126 may include a launching mechanism engagement region 66 with a barb, hook, or other suitable structure 68 configured to be selectively inserted through second end 48 of propulsion spring housing 38. Launching mechanism 34 may be configured to permit insertion of launching mechanism engagement region 66 into propulsion spring housing 38 such that launching mechanism engagement region 66 engages propulsion spring release member 40 causing it to slide within propulsion spring release member housing 44 against the bias of propulsion spring release spring 42, as generally indicated in FIG. 8. Upon further insertion of launching mechanism engagement region 66, region 66 may pass through passage 64 and engage and compress propulsion spring 36. Upon even further insertion of launching mechanism engagement region 66, propulsion spring release spring 42 may bias propulsion spring release member 40 such that barb 68 engages propulsion spring release member 40 and retains launching mechanism engagement region 66 within propulsion spring housing 38, as indicated generally in FIG. 9.

Launching mechanism 34 may be configured to permit user engagement of surface 62, such as by pressing down on surface 62. Such engagement may provide a force against the bias of propulsion spring release spring 42, causing passage 64 to slide relative to launching mechanism engagement region 66, and thus disengage barb 68 from propulsion spring release member 40. Therefore the bias of propulsion spring 36 may be permitted to forcefully eject launching mechanism engagement region 66 from propulsion spring housing 38 and thus projectile 126 away from launching mechanism 34.

Launching mechanism 34 may be configured generally as indicated in FIGS. 7-9; however, launching mechanism 34 may be configured in other suitable arrangements such that launching mechanism 34 is configured to engage and selectively retain launching mechanism engagement region 66 of projectile 126 and to further provide motive power to projectile 126 upon appropriate user manipulation of toy 10. For example, springs 36, 42 are shown to be generally in compression. However, launching mechanism 34 may be configured such that either of or both springs 36, 42 may be positioned such that the necessary bias force is in tension rather than compression. Additionally or alternatively, other energy-storing or applying mechanism or mechanisms may be used.

Turning now to FIGS. 10-11, an illustrative non-exclusive embodiment of toy 10 is presented. As discussed, toy 10 may include housing 12 which may be in the form of a toy vehicle 412, such as a stylized BATMOBILE® toy vehicle. In the embodiment depicted, toy vehicle 412 has a front end 116 and a rear end 118 and includes integral binoculars 120 with a left view port 122 and a right view port 124. Toy vehicle 412 includes a left portion 128, a right portion 130, and a connecting mechanism 132 operatively coupling portions 128, 130.

Toy 10 also includes object 26, in the form of projectile 126. In the depicted embodiment, projectile 126 is in the form of a second toy vehicle 226, or more specifically a BATMAN® luge, or skateboard, with a BATMAN® action FIG. 70 operatively coupled thereto.

In FIG. 10, toy vehicle 412 is shown in the closed configuration 112. In FIG. 11, toy vehicle 412 is shown in the fully open configuration 312 with the second toy vehicle 226 launched from within the toy vehicle 412.

As shown in FIG. 11, toy vehicle 412 includes a launching mechanism 134 integral to the connecting mechanism 132 and configured to operatively engage and launch the second toy vehicle 226. Launching mechanism 134 may functionally operate like launching mechanism 34 discussed above and schematically illustrated in FIGS. 7-9. A trigger, or user engagement surface 162, when depressed by a user, may operatively release second toy vehicle 226 from the launching mechanism so that an internal biasing mechanism effectively launches the second toy vehicle away from the launching mechanism and thus away from toy vehicle 412.

It is believed that the disclosure set forth above encompasses multiple distinct inventions with independent utility. While each of these inventions has been disclosed in a preferred form or method, the specific alternatives, embodiments, and/or methods thereof as disclosed and illustrated herein are not to be considered in a limiting sense, as numerous variations are possible. The present disclosure includes all novel and non-obvious combinations and subcombinations of the various elements, features, functions, properties, methods and/or steps disclosed herein. Similarly, where any disclosure above or claim below recites "a" or "a first" element, step of a method, or the equivalent thereof, such disclosure or claim should be understood to include one or more such elements or steps, neither requiring nor excluding two or more such elements or steps.

Inventions embodied in various combinations and subcombinations of features, functions, elements, properties, steps and/or methods may be claimed through presentation of new claims in a related application. Such new claims, whether they are directed to a different invention or directed to the same invention, whether different, broader, narrower, or equal in scope to the original claims, are also regarded as included within the subject matter of the present disclosure.

We claim:

1. A toy, comprising:

a housing including a first portion, a second portion, a connecting mechanism joining the first and second portions together, and at least one view port disposed within the housing and adapted to permit a user to view objects external to the toy through the at least one view port, the at least one view port including an elongate passage having first and second ends to allow a user to view objects adjacent to the second end by placing the first end adjacent to an eye of the user and the user looking toward the second end through the elongate passage, wherein the first and second portions are configured to be selectively manipulated between a closed configuration and an open configuration;

a projectile; and a launching mechanism coupled to the housing and configured to engage and retain the projectile within the housing when the housing is in either a closed configuration and an open configuration, and selectively forcefully eject and thereby launch the projectile away from the housing only when the housing is in an open configuration, the launching mechanism including a trigger and an internal biasing mechanism, the trigger configured, when activated by a user, to operatively release the projectile such that the internal biasing mechanism forcefully ejects and launches the projectile away from the housing;

wherein in the closed configuration, the first and second portions enclose the projectile and the trigger within the housing so that a user cannot access and activate the trigger and the projectile cannot be launched from the housing, and in the open configuration, the first and second portions are spaced apart to reveal the trigger and the projectile within the housing so that a user may access and activate the trigger and the projectile may be launched from the housing.

2. The toy of claim 1, wherein the projectile is a toy vehicle.

3. The toy of claim 1, wherein the housing is a toy vehicle.

4. The toy of claim 3, wherein the projectile is a toy vehicle.

5. The toy of claim 1, wherein the at least one view port includes a first view port disposed within the first portion and a second view port disposed within the second portion.

6. The toy of claim 1, wherein the at least one view port is configured to magnify objects viewed through the at least one view port.

7. A toy, comprising:

a housing in the form of a toy vehicle, the housing including a first portion, a second portion, and a connecting mechanism joining the first and second portions together, wherein the first and second portions are configured to be selectively manipulated between a closed configuration wherein the portions are substantially adjacent each other and in a relative physical orientation with respect to each other and an open configuration wherein the portions are spaced from each other but remain in the same relative physical orientation with respect to each other; and first and second view ports disposed within the housing and adapted to permit a user to view objects external to the toy through the first and second view ports, the first view port including a first elongate passage having first and second ends, the second view port including a second elongate passage having third and fourth ends, the first and second view ports configured to allow a user to view objects adjacent to the second and fourth ends by placing the first end adjacent to the user's left eye, placing the third end adjacent to the user's right eye, the user looking toward the second end through the first elongate passage with the left eye, and the user looking toward the fourth end through the second elongate passage with the right eye;

wherein the housing includes a launching mechanism configured to selectively engage and retain a projectile within the housing when the housing is in either a closed configuration and an open configuration, the launching mechanism including a propulsion spring and a trigger configured to be selectively actuated by a user to allow the propulsion spring to forcefully eject and launch the projectile away from the housing;

wherein in the closed configuration, the first and second view ports are adjacent to each other and the first and second portions generally enclose the projectile and the trigger within the housing so that the trigger cannot be actuated and the projectile cannot be launched from the housing, and wherein in the open configuration, the first and second view ports are spaced from each other relative to the closed configuration and the first and second portions are spaced apart to reveal the trigger and the projectile within the housing so that the trigger can be actuated and the projectile may be launched from the housing.

8. The toy of claim 7, wherein the first and second view ports are adapted to magnify objects viewed through the first and second view ports.

9. The toy of claim 7, in combination with the projectile.

10. The toy of claim 7, wherein the projectile is a second toy vehicle.

11. The toy of claim 7, wherein the first view port is disposed within the first portion of the housing and the second view port is disposed within the second portion of the housing.

* * * * *